United States Patent [19]

Smith

[11] 3,965,843

[45] June 29, 1976

[54] TRANSPORTING APPARATUS

[76] Inventor: Charles E. Smith, 7932 Eisenhower Blvd., Bridgeport, N.Y. 13030

[22] Filed: Dec. 19, 1974

[21] Appl. No.: 534,646

[52] U.S. Cl. ..... 115/19; 115/.5 A; 115/63; 180/9.26

[51] Int. Cl.[2] ..... B63H 1/34; B63H 16/00

[58] Field of Search ..... 115/.5 A, .5 Z, 19, 115/63, 49, 20, 25, .5 B, 26, 1 R; 180/9.24 R, 9.26, 7 R, 9, 15, 16, 74; 305/20; 415/5, 7; 416/7

[56] References Cited

UNITED STATES PATENTS

| | | | |
|---|---|---|---|
| 999,971 | 8/1911 | Eckley | 180/9.64 X |
| 2,282,745 | 5/1942 | Preston | 180/1 C |
| 2,812,081 | 11/1957 | Schrader | 180/1 C |
| 3,050,347 | 8/1962 | Levi | 305/20 |

FOREIGN PATENTS OR APPLICATIONS

| | | | |
|---|---|---|---|
| 1,002,650 | 2/1957 | Germany | 115/.5 A |

*Primary Examiner*—Trygve M. Blix
*Assistant Examiner*—Gregory W. O'Connor
*Attorney, Agent, or Firm*—Charles S. McGuire

[57] ABSTRACT

A device for receiving motive power from a source supported thereon and transmitting the power to the underlying surface thereby imparting motion across such surface to the device and power source supported thereon. The device is particularly adapted for transport over water, but is also suited to move over land, including snow, mud, marshy areas, etc. A continuous belt surrounds a pair of rotatable, buoyant cylinders and receives rotational power from a contacting, second continuous belt surrounding a second pair of cylinders. The power source may comprise one or more individuals, bicycles, motorcycles, automobiles, etc., supported by and transmitting power directly to the second belt.

6 Claims, 3 Drawing Figures

TRANSPORTING APPARATUS

BACKGROUND OF THE INVENTION

The present invention relates to apparatus for transporting over water or other surfaces, one or more individuals or other means for imparting motive power to the apparatus.

The prior art includes numerous examples of buoyant apparatus in the form of rafts, pontoons, etc., for transporting self-powered means, such as automobiles, over bodies of water. Means may also be provided for transmitting power from the transported power source to the apparatus upon which it is supported. For example, in U.S. Pat. Nos. 1,419,977 and 1,568,307, rotation of the automobile wheels is transmitted to a submerged propeller for imparting motion to the raft supporting the auto. U.S. Pat. No. 3,270,827 discloses means for coupling the automobile engine to a power fan and propeller means in a Ground Effect Machine. In U.S. Pat. Nos. 2,342,535 and 3,611,978 rotation of the automobile wheels is transmitted to paddle wheels on the buoyant transporting means.

Still other patents disclose devices for supporting a human operator and transferring walking motion to rotation for propelling the device over the surface of the water. In general, such devices are in the form of cylinders, spheres, or the like, inside which the operator stands while imparting the motive power.

In general, however, such devices are designed to transport and receive motive power from only one type of power source, whether human or mechanical. Also, aside from those types designed to fully or partially enclose and transport single individuals, such devices have been inefficient due to the drag created by non-moving parts on or below the water surface.

It is a principal object of the present invention to provide buoyant transporting apparatus of a type wherein substantially all parts in contact with the water are adapted to move in a direction imparting movement in the desired direction to the apparatus.

A further object is to provide a single type of buoyant apparatus suitable for simultaneously transporting and receiving motive power from any source such as human operators, automobiles, motorcycles, bicycles, etc.

Another object is to provide buoyant transporting means for moving a plurality of persons over a body of water with linear motion provided by combined walking movement of such persons.

A still further object is to provide apparatus suitable for receiving motive power from one or more individuals to move over a body of water wherein the individuals are not enclosed by any structure, but rather stand upon an upper surface of the apparatus above the water surface.

BRIEF SUMMARY OF THE INVENTION

In accordance with the foregoing objects the invention includes at least one pair of buoyant elements in the form of elongated cylinders rotatably supported and maintained by suitable frame means with their axes spaced, parallel and in a common horizontal plane. These cylinders are surrounded by a continuous belt preferably having paddle means on the outer surface. A second pair of cylinders is rotatably supported by the frame means with their axes spaced, parallel and in a common horizontal plane, above the plane of the first cylinder's axes. The second cylinders are also surrounded by a continuous belt, all or most of the lower outside surface of which frictionally engages the upper outside surface of the belt surrounding the first cylinders. The size, strength, material, etc., of the belts is commensurate with the intended use, as is the buoyancy of the first pair of cylinders.

In some embodiments it is preferred that each of the cylinders of both pairs be divided at the center by a vertical plane, whereby each cylinder actually is formed in two independently rotatable, end-to-end halves. The belts are likewise divided so that separate upper and lower belts are provided on the right and left sides. By varying the speed or reversing the direction of motive power to one side or the other, the apparatus may be steered in its course over the water.

DETAILED DESCRIPTION

Figure 1:
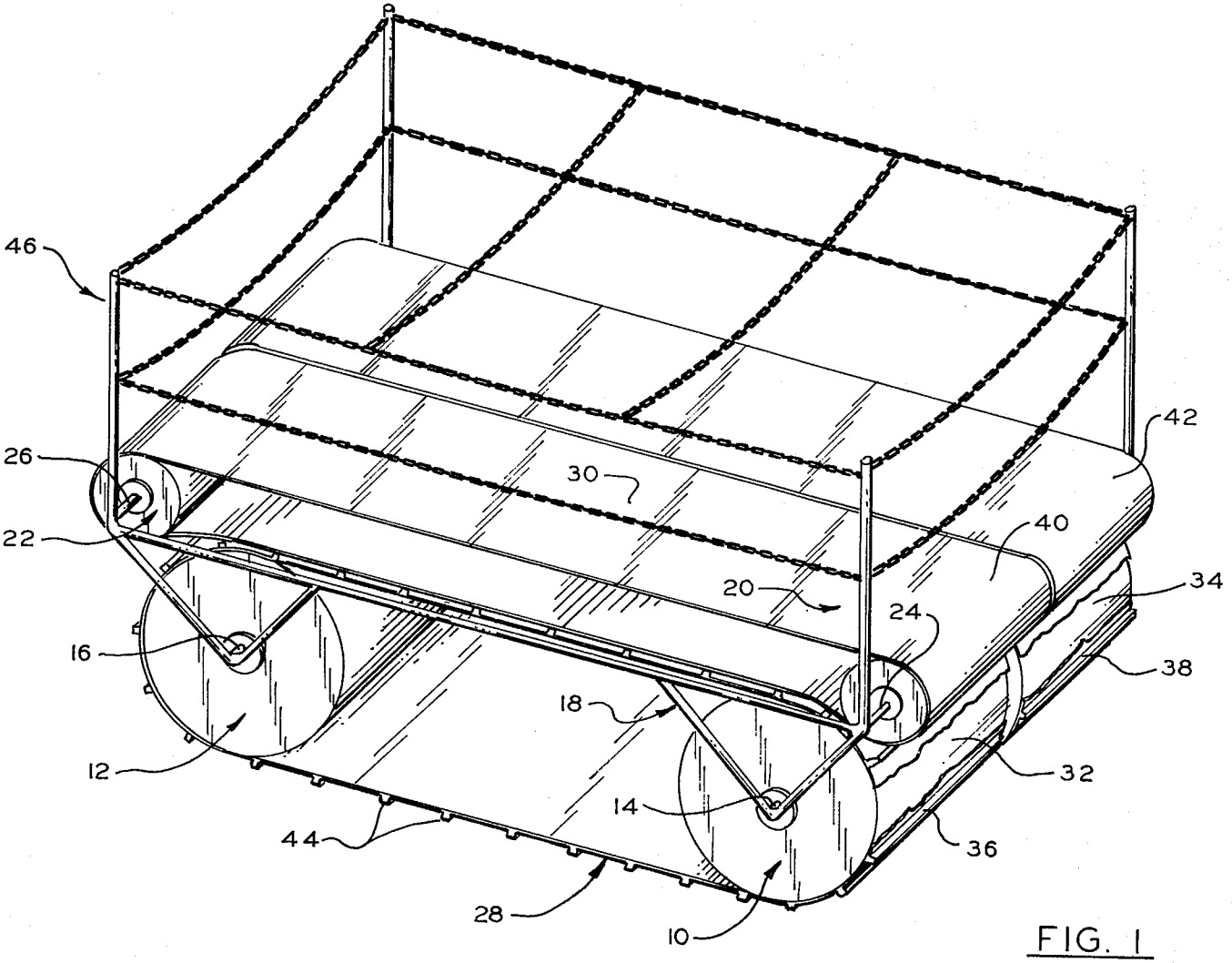
FIG. 1 is a perspective view of a preferred embodiment of the invention particularly adapted to the transporting of individuals.

Referrring now to the drawings, in FIG. 1 is shown a basic example of the transporting apparatus of the invention. A first pair of cylinders 10 and 12 are rotatably supported on axles 14 and 16 extending between rigid frame means on each side of the apparatus. The portion of the frame means seen in FIG. 1 is denoted generally by reference numeral 18, an identical portion (not shown) being provided on the opposite side. A second pair of cylinders 20 and 22 are rotatably mounted on axles 24 and 26, also extending between the opposite sides of frame means 18.

Surrounding cylinders 10 and 12 in frictional engagement is continuous belt 28. A second continuous belt 30 likewise encircles the second pair of cylinders 20 and 22. Although all of cylinders 10, 12, 20 and 22 and belts 28 & 30 may be of unitary construction, in the preferred embodiment of the construction shown in FIG. 1, each pair of cylinders and associated belt is divided at the center to form two independently rotatable cylinder and belt combinations. That is, cylinder 10 comprises end-to-end cylinder halves 32 and 34 of equal diameter and mounted on the same axle. Cylinders 12, 20 and 22 are similarly divided although the individual, right and left cylinder halves are not separately numbered.

Arbitrarily designating cylinder halves 32 and 34 as right and left, respectively, lower belt 28 includes separate, right and left portions 36 and 38. Upper belt 30 is likewise formed in separate portions 40 and 42. The lower, outside surface of upper right belt portion 40 is in frictional contact over substantially its entire surface with lower right belt portion 36. Upper left belt portion 42 similarly contacts lower left belt portion 38. Thus, by providing motive power to upper belt portions 40 and 42 in either direction, lower belt portions 36 and 38 are rotated in the opposite direction.

Each portion of lower belt 28 is preferably provided with radial ribs 44 extending laterally along the external surface thereof. At least the lower pair of cylinders 10 and 12 are constructed in a manner, or of a material, which provides buoyancy to a degree that the weight of the apparatus and the anticipated load to be transported thereby, will float on water. Belt 28 is also preferably constructed of buoyant material. Preferably, when fully loaded the apparatus is submerged to no greater extent than to the upper surface of belt 28.

An appropriate superstructure, indicated generally by reference numeral 46, extends upwardly from rigid attachments to frame means 18. In the form shown, upright posts at the corners are attached by members which may be rigid, if required for added structural stability, or flexible, such as cables or chains. This form of the apparatus is especially suited for transporting a number of individuals standing on the upper surface of belt 30 and providing rotational power thereto by walking motion, i.e., in treadmill fashion, rotating belt 30 in one direction and belt 28 in the opposite direction. Ribs 44 will act as paddle means, assisting propulsion of the apparatus in either direction. The structure of FIG. 1 is arranged for three persons to stand on each of belt portions 40 and 42 with cross members provided on superstructure 46 at about waist height for each person to grasp. Since the apparatus is symmetrical from end to end, the individuals may face in either direction. It will also be seen that by providing separate, right and left cylinder and belt pairs on both the upper and lower sides that the transporting apparatus may be steered. That is, the rotational speed imparted by walking movement of the individuals on one of belts 40 and 42 may be slowed, stopped or reversed, relative to the direction and speed of rotation imparted to the other belt, in order to induce a turning movement in either direction.

Figure 2:
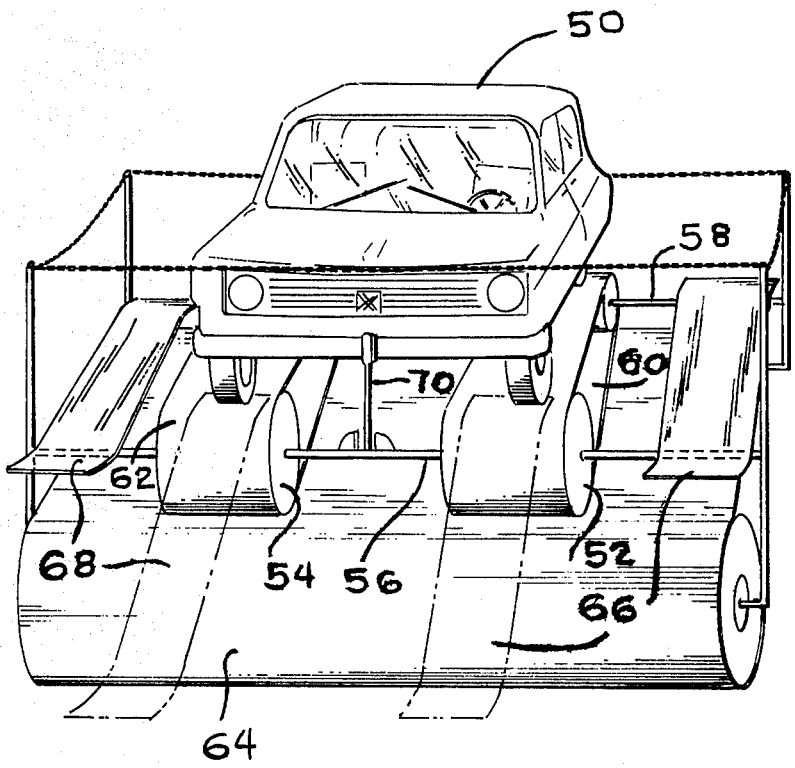
FIG. 2 is a perspective view of a modified form of the apparatus.

Turning now to FIG. 2, a somewhat modified form of the apparatus is shown, particularly adapted to transport and receive motive power from a four wheeled vehicle, such as automobile 50, which may be either two or four wheel drive. In this form, the apparatus includes a pair of cylinder halves 52 and 54 mounted on axle 56, and an identical pair of cylinder halves at the opposite end mounted on axle 58. Continuous upper belt portions 60 and 62 surround the respective pairs of upper cylinder halves.

The lower cylinders are each provided in a single piece, surrounded by a single continuous belt 64. The automobile may be driven on and off the apparatus with the aid of ramps 66 and 68, shown in solid lines in a stored position on axles 56 and 58, and in dot-dash line in the operative position, which may be at either the front or rear of the vehicle. Suitable anchor means 70 are provided at both the front and rear for fixing the position of the vehicle or the transporting apparatus as power is transferred from the vehicle wheels to belts 60 and 62, and thence to belt 64. Although none are shown in FIG. 2, radial extensions providing paddle means may be provided on the outside surface of belt 64 in the same manner as in the FIG. 1 embodiment.

Figure 3:
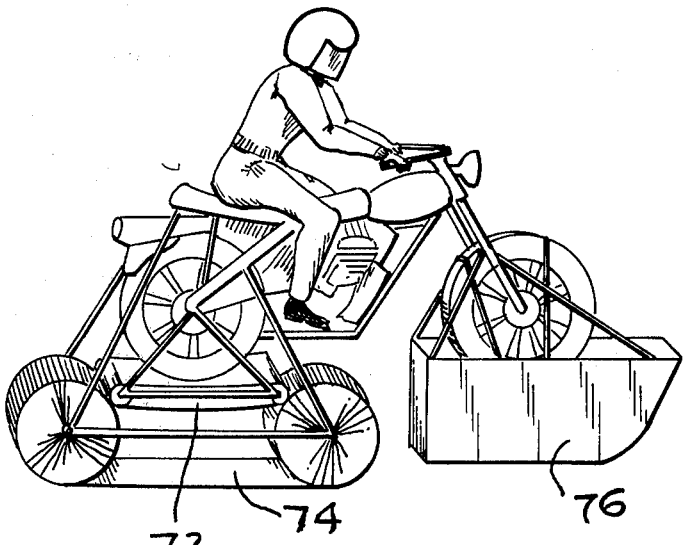
FIG. 3 is an elevational view of still another form.

The form of the apparatus shown in FIG. 3 is designed to transport a two wheeled vehicle, such as a bicycle or motorcycle. The powered wheel rests on upper belt 72, rotation of which is transmitted to lower belt 74 in the same manner as the previously described constructions. Rather than supporting the entire vehicle upon the upper belt of the apparatus, the front wheel is attached to a float or pontoon 76. The size, material, etc., of float 76 are designed to provide the required degree of buoyancy for transport over water, and the float is preferably relatively narrow to facilitate transport over snow, and the like.

Although not illustrated in detail, the frame means of each embodiment support the upper and lower pairs of cylinders for rotation about spaced, parallel axes, as well as supporting any appropriate superstructure or anchoring or support means for the individuals and/or vehicles to be transported. Also, in each embodiment, substantially all of the submerged portion of the apparatus is moving to provide propulsion through the water in the desired direction, thereby minimizing friction and drag.

What is claimed is:

1. Buoyant apparatus for supporting a nominal load including a power source adapted to transmit motive power to said apparatus, thereby providing movement of said apparatus and load over a body of water, said apparatus comprising:

a. first and second pairs of cylinders having parallel, horizontal axes, at least said first pair being sufficiently buoyant to maintain said apparatus and the nominal load to be carried thereby submerged in water not further than approximately the diameter of said first pair of cylinders;

b. frame means maintaining said cylinders with the axe of said first pair in a first horizontal plane and the axes of said second pair in a second horizontal plane, above said first plane by a distance substantially equal to the combined radii of said first and second cylinders, c. at least one continuous first belt of substantially the same width as said first pair of cylinders and encircling the same in such relation as to transmit rotation between said first belt and first pair of cylinders;

d. at least one continuous second belt of substantially the same width as said second pair of cylinders and encircling the same in such relation as to transmit rotation between said second belt and second pair of cylinders;

e. said frame means maintaining said cylinders in such relation that a significant portion of the unwardly facing, outer surface of said first belt is in contact with substantially the entire downwardly facing, outer surface of said second belt for transmission of rotation between said belts, the upwardly facing, outer surface of said second belt being disposed for support of the power source providing motion thereto;

f. whereby, when supporting said nominal load, substantially all parts of said apparatus in contact with said body of water are adapted to move in a direction imparting said movement of said apparatus and load over said body of water in the desired direction by providing propulsion through said body of water in the desired direction thereby minimizing friction and drag.

2. The invention according to claim 1 wherein the outer surface of at least said first belt is provided with radially extending ribs arranged laterally across said outer surface.

3. The invention according to claim 2 wherein all of said cylinders are of substantially the same width.

4. The invention according to claim 1 wherein said second pair of cylinders and said second belt are divided into right and left halves of substantially equal width, each cylinder half being mounted on a common axle and spaced apart by a significant distance, each cylinder of said first pair being in a single piece having a width at least as great as the combined width of the cylinder halves of said second pair and the spacing therebetween.

5. The invention according to claim 4 and further including anchoring means for attachment between said apparatus and a vehicle resting on the upper surface of said second belt.

6. The invention according to claim 1 wherein each of said cylinders and belts are divided in a vertical plane substantially midway of their widths into right and left, independently rotatable halves.

* * * * *